US011365554B2

(12) United States Patent
Chia

(10) Patent No.: US 11,365,554 B2
(45) Date of Patent: Jun. 21, 2022

(54) POLE WITH PIVOTABLE ACCESS COVER

(71) Applicant: Photizo Global Pte Ltd, Singapore (SG)

(72) Inventor: Ho Meng Chia, Singapore (SG)

(73) Assignee: Photizo Global Pte Ltd, Singapore (SG)

( * ) Notice: Subject to any disclaimer, the term of this patent is extended or adjusted under 35 U.S.C. 154(b) by 0 days.

(21) Appl. No.: 16/964,841

(22) PCT Filed: Aug. 20, 2019

(86) PCT No.: PCT/SG2019/050412
§ 371 (c)(1),
(2) Date: Jul. 24, 2020

(87) PCT Pub. No.: WO2021/034263
PCT Pub. Date: Feb. 25, 2021

(65) Prior Publication Data

US 2021/0246680 A1 Aug. 12, 2021

(51) Int. Cl.

| | |
|---|---|
| ***E04H 12/00*** | (2006.01) |
| ***F21V 21/10*** | (2006.01) |
| ***E04H 12/18*** | (2006.01) |
| ***F21S 8/08*** | (2006.01) |

(52) U.S. Cl.
CPC ..... *E04H 12/003* (2013.01); *E04H 12/187* (2013.01); *F21S 8/085* (2013.01); *F21V 21/10* (2013.01)

(58) Field of Classification Search
CPC ..... E04H 12/003; E04H 12/187; F21S 8/085; F21S 8/086; F21S 8/088; F21V 21/10
USPC ..... 52/844, 845, FOR. 136, FOR. 142, 52/FOR. 143, FOR. 144
See application file for complete search history.

(56) References Cited

U.S. PATENT DOCUMENTS

| | | | | | |
|---|---|---|---|---|---|
| D22,432 | S | * | 5/1893 | Schoen | D25/129 |
| 3,196,990 | A | * | 7/1965 | Handley | E04H 12/08 52/844 |
| 3,276,182 | A | * | 10/1966 | Handley | E04H 12/08 52/844 |
| 3,959,946 | A | * | 6/1976 | Holmes | E04H 12/003 52/845 |

(Continued)

FOREIGN PATENT DOCUMENTS

| | | | | |
|---|---|---|---|---|
| AU | 2017279669 | A1 | 1/2019 | |
| FR | 2654184 | A1 * | 5/1991 | F21V 21/10 |

(Continued)

OTHER PUBLICATIONS

Translation of WO 2018/119502. (Year: 2018).*

(Continued)

*Primary Examiner* — Michael Safavi

(57) ABSTRACT

A pole for supporting at least one device thereon, the pole comprising: a post to support weight of the pole and to attach the at least one device thereto; and at least one cover at least partially covering at least one side of the post, the post and the at least one cover together defining at least part of a longitudinal channel in the pole to house the at least one device attached to the post; wherein an edge of the cover is in pivotable engagement with the post to allow access to the post in the longitudinal channel.

14 Claims, 4 Drawing Sheets

(56) References Cited

U.S. PATENT DOCUMENTS

| | | | | | |
|---|---|---|---|---|---|
| 4,216,632 | A * | 8/1980 | Mack | E04H 12/08 52/40 |
| 4,551,792 | A * | 11/1985 | Hoke | F21S 8/088 362/311.01 |
| 6,357,196 | B1 * | 3/2002 | McCombs | E04C 3/14 138/166 |
| 7,827,762 | B2 * | 11/2010 | Griffiths | E04F 13/0733 52/834 |
| 9,016,023 | B2 * | 4/2015 | Timko | E04C 3/30 52/651.07 |
| 9,121,194 | B2 * | 9/2015 | Chan | E04H 12/085 |
| 2015/0089901 | A1 | 4/2015 | Chan | |
| 2021/0116088 | A1 * | 4/2021 | Bijl | H05K 7/20136 |
| 2021/0320393 | A1 * | 10/2021 | Williams | H01Q 1/1221 |

FOREIGN PATENT DOCUMENTS

| | | | | |
|---|---|---|---|---|
| FR | 2654184 | A1 | 5/1991 | |
| FR | 2692929 | A1 * | 12/1993 | E04H 12/003 |
| KR | 101042293 | B1 | 6/2011 | |
| KR | 20110131978 | A * | 12/2011 | F21S 8/085 |
| WO | WO-2017072452 | A1 * | 5/2017 | E04H 12/187 |
| WO | WO-2017072455 | A1 * | 5/2017 | H01Q 1/1235 |
| WO | WO-2018119502 | A1 * | 7/2018 | E04H 12/08 |
| WO | WO-2018231146 | A1 * | 12/2018 | H02G 3/0493 |
| WO | 2021034263 | A1 | 2/2021 | |

OTHER PUBLICATIONS

Translation of WO 2017/072452. (Year: 2017).*

Translation of KR 20110131978 A. (Year: 2011).*

Foreign Communication from a Related Counterpart Application, International Search Report and Written Opinion dated Oct. 15, 2019, International Application No. PCT/SG2019/050412 filed on Aug. 20, 2019.

Foreign Communication from a Related Counterpart Application, GCC Examination Report dated Sep. 19, 2021, International Application No. GC 2020-40146 filed on Jul. 22, 2020.

* cited by examiner

POLE WITH PIVOTABLE ACCESS COVER

CROSS-REFERENCE TO RELATED APPLICATIONS

The present application is a filing under 35 U.S.C. 371 as the National Stage of International Application No. PCT/SG2019/050412, filed Aug. 20, 2019, entitled "POLE," which is incorporated herein by reference in its entirety for all purposes.

FIELD

This invention relates to a pole for supporting devices.

BACKGROUND

Poles are traditionally used to raise lighting fixtures for illuminating roads and walkways. In smart city infrastructure with Internet-of-Things (IoT) connectivity, poles used for lighting may also conveniently be used as supports or attachment points for IoT and/or other electrical or electronic devices such as cameras, sensors, communication nodes and so on that may be used to implement various functions of the smart city and inter-networking of physical devices. Currently, providing devices as part of smart city infrastructure is performed on an ad-hoc basis where each device is mounted onto an existing light pole or street sign pole and connected individually, resulting in an untidy and aesthetically unpleasant finish as well as being labour intensive and time consuming to perform.

SUMMARY

According to a first aspect, there is provided a pole for supporting at least one device thereon, the pole comprising: a post to support weight of the pole and to attach the at least one device thereto; and at least one cover at least partially covering at least one side of the post, the post and the at least one cover together defining at least part of a longitudinal channel in the pole to house the at least one device attached to the post; wherein an edge of the cover is in pivotable engagement with the post to allow access to the post in the longitudinal channel.

The pivotable engagement may comprise at least one hinge having a first hinge portion integral with the post and a second hinge portion integral with the cover such that the cover directly and pivotably engages the post without anything in between.

The first hinge portion and the second hinge portion may each comprise detachably mating structures that rotatably engage each other over a predetermined angle of rotation between a closed position of the cover and a widest possible open position of the cover relative to the post.

The pivotable engagement may comprise a plurality of hinges spaced apart from each so other by intervals greater than a length of one hinge.

The post may comprise a number of ribs and the at least one cover may comprise a number of covers corresponding to the number of ribs, the pole comprising a number of longitudinal channels corresponding to the number of covers, wherein each of the number of longitudinal channels is defined by one cover and two adjacent ribs.

The at least one cover may comprise a number of vertically arranged covers.

The at least one cover may be at least partially curved and/or angled about a longitudinal axis.

The post may be at least partially curved and/or angled about a longitudinal axis.

The at least one cover may be readily assembled with and detached from the post by hand without requiring use of tools.

Total height of the at least one cover may span at least most of a full length of the post.

BRIEF DESCRIPTION OF FIGURES

In order that the invention may be fully understood and readily put into practical effect there shall now be described by way of non-limitative example only exemplary embodiments of the present invention, the description being with reference to the accompanying illustrative drawings.

DETAILED DESCRIPTION

Figure 1:
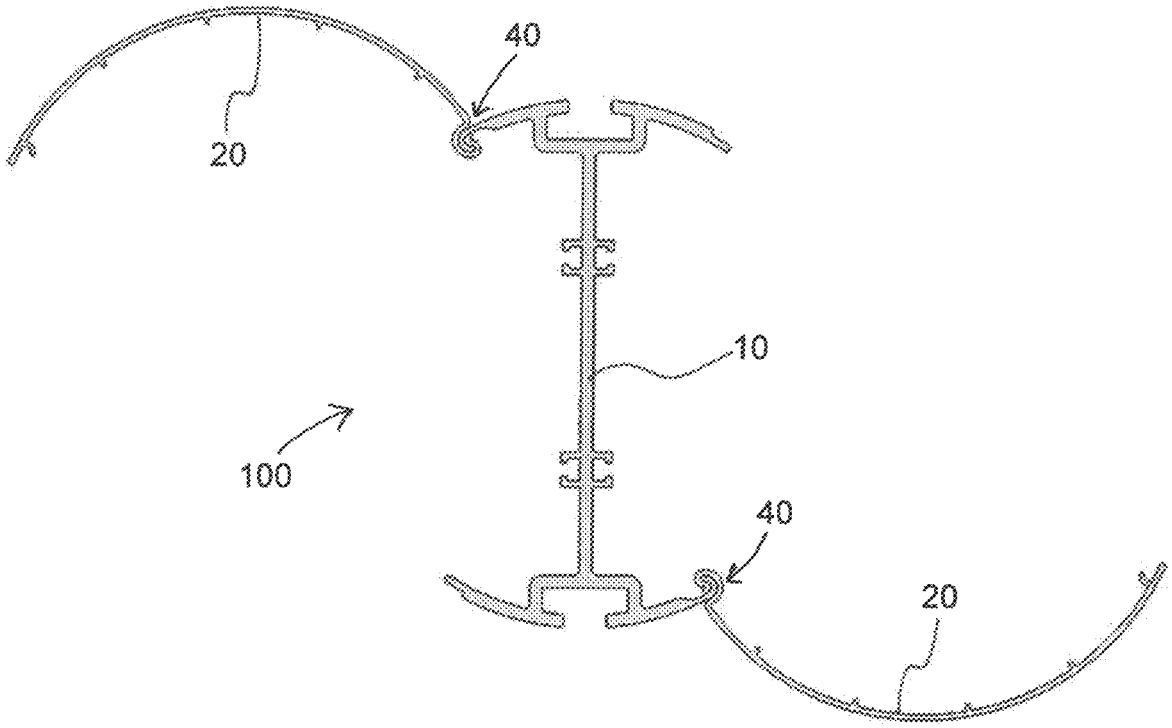
FIG. 1 is a schematic cross-sectional view of a first exemplary embodiment of the pole having open covers.

Exemplary embodiments of a pole 100 configured to support devices will be described below with reference to FIGS. 1 to 9. The same reference numerals are used in the different figures to denote the same or similar parts. Throughout the specification, the term "device" is used to refer to IoT and other electrical or electronic devices 50 as well as one or more lighting fixture 51 (FIG. 3) that may or may not be provided on the pole 100, so that the pole 100 may be used as a light pole on which other devices are provided, or as a specially provided pole 100 provided to support devices without light fixtures, with or without supporting other objects 70 (FIG. 3) such as street signs, banners or decorative items.

Figure 2:
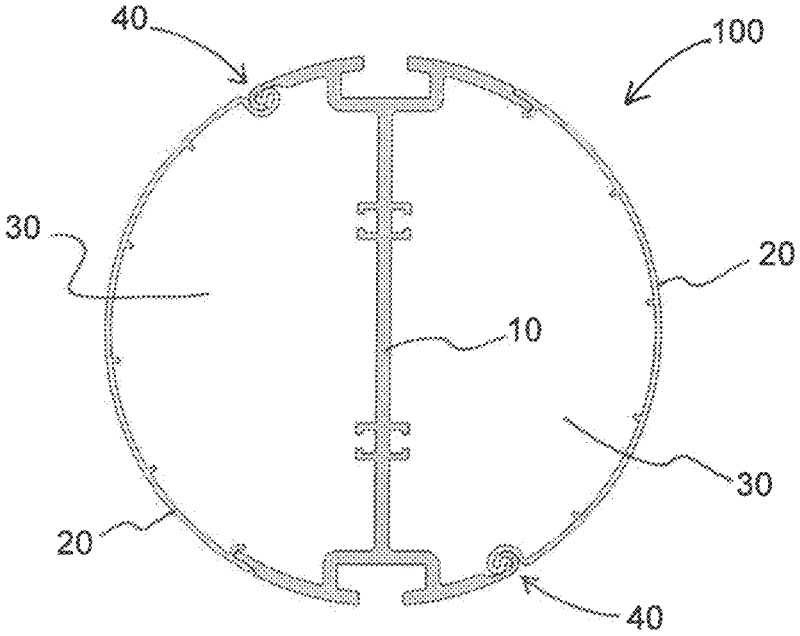
FIG. 2 is a schematic cross-sectional view of the pole of FIG. 1 having closed covers.
Figure 3:
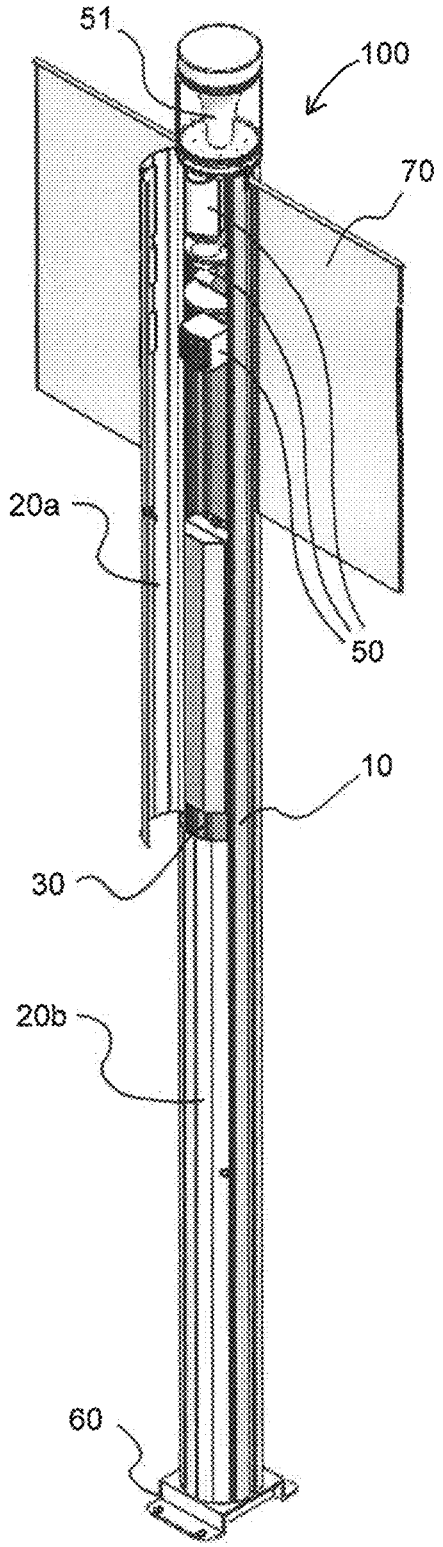
FIG. 3 is a perspective view of the pole of FIG. 1.

In general, as shown in FIGS. 1 to 4, the pole 100 comprises a post 10 that functions as a structural support for the pole 100 that in use is provided in a generally upright position. The post 10 is preferably made of a metal, for example aluminium, and is preferably corrosion resistant in order to be suitable for outdoor use. In alternative embodiments, the post 10 may be made of wood, fibre, plastic, concrete or a composite material. One or more devices 50 may be attached to the post 10, as shown in FIG. 3, and in some embodiments, attachment points may be provided along the post 10 for convenient attachment of devices 50 to the post 10. The pole 100 also comprises at least one cover 20, the at least one cover 200 at least partially covering at least one side of the post 10. The post 10 and the at least one cover 20 together define at least part of a longitudinal channel 30 in the pole 100 to house devices 50 that are attached to the post 10.

An edge of each cover 20 is in pivotable engagement 40 with the post 10 to allow access to the post 10 in the longitudinal channel 30 by swinging the cover 20 open relative to the post 10. The at least one cover 20 may be made of any desired material that is preferably weather resistant. In an exemplary embodiment, the at least one cover 20 may comprise a rectangle that is curved about a longitudinal axis so that a cross-sectional shape of the cover 20 comprises an arc (as shown in FIGS. 1 and 2) and a long side of the curved rectangular cover 20 is in pivotable engagement 40 with the post 10 (as shown in FIGS. 3, 5, and 7-9).

Depending on the length of the pole 100, the at least one cover 20 may have a total height spanning at least most of a full length of the post 10. For example, as shown in FIG. 3, the at least one cover 20 comprises four covers (two in front visible and labelled 20*a*, 20*b*, two behind the post 10 not visible), wherein two vertically arranged covers 20*a*, 20*b* define a longitudinal channel 30 with the post 10 and the total height of two vertically arranged covers 20*a*, 20*b* spans the full length of the post 10. In FIG. 3, the upper cover 20*a* is shown open while the lower cover 20*b* is shown closed. While FIG. 3 depicts two vertically arranged covers 20*a*, 20*b* making up the full height of the post 10, the number of covers 20 arranged vertically along the length of the post 10 may be one, three or more as desired. Also, the vertically arranged covers 20 need not be uniform in height. The height of each of the covers 20 in the pole 100 may be customised as desired while the total height of a number of covers 20 that are vertically arranged one on top of another span at least most of the length of the pole 100.

The at least one cover 20 of the pole 100 is configured to allow any part of the post 10 along the full length of the post 100 to be accessed, while also serving as an aesthetically pleasing exterior finish for the pole 100. Having full and ready access to any part of the post 10 is advantageous in allowing IoT or other devices 50 to be attached to the post 10 at any height along the pole 100. Providing one or more longitudinal channels 30 within the pole 100 also allows attached devices 50 to be concealed within the pole 100 in the one or more longitudinal channels 30, thereby providing a clean and aesthetically pleasing appearance to the pole 100. The at least one cover 20 allowing easy access to the attached devices 50 in the longitudinal channel 30 is also advantageous in allowing servicing, upgrades, replacements or any other desired activity to be carried out on the attached devices 50. Importantly, opening or even total removal of the at least one cover 20 does not compromise structural integrity of the pole 100 as the at least one cover 20 is not load bearing and all structural loads on the pole 100 are borne by the post 10.

Figure 4A:
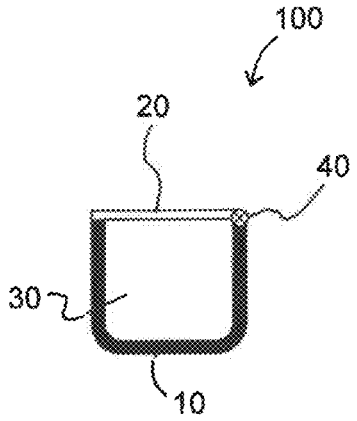
FIGS. 4A and 4B show cross-sectional views of alternative exemplary embodiments of the pole having closed covers.
Figure 4B:
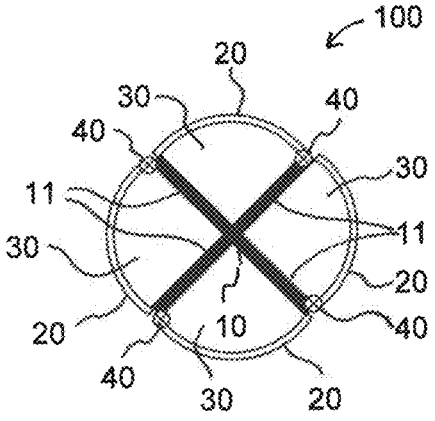
Figure 5:
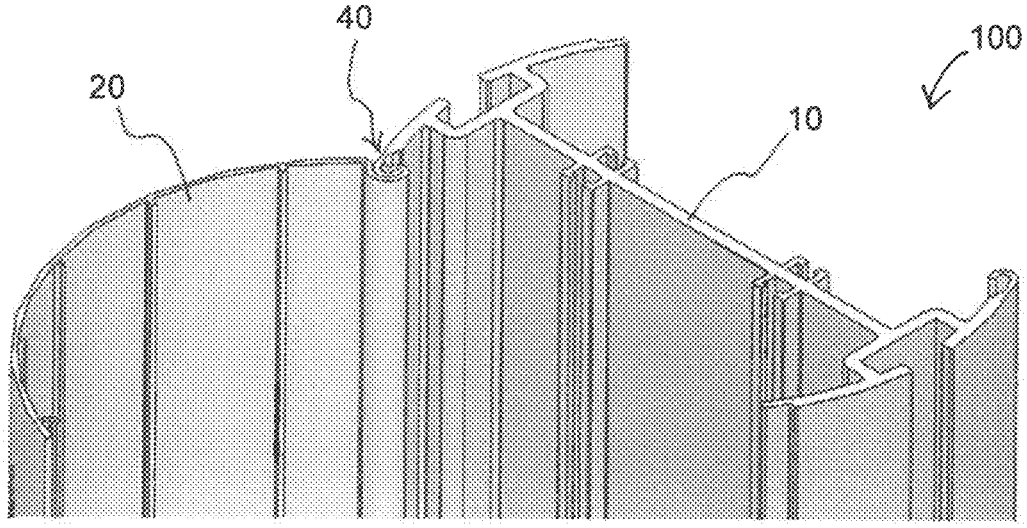
FIG. 5 is a close-up perspective view of an exemplary embodiment of a hinge in the pole.

In some embodiments, as shown in FIGS. 1 and 2, a cover 20 may be provided on each of two sides of the post 10 so that two sides of the post 10 are covered and two longitudinal channels 30 are provided in the pole 100. In other embodiments, the pole 100 may comprise only one longitudinal channel 30 along its length by covering only one side of the post 10 (FIG. 4*a*), or the pole 100 may comprise two or more longitudinal channels 30 by covering four sides of the post 10 (FIG. 4*b*) as may be desired. Accordingly, to provide a desired number of longitudinal channels 30 within the pole 100, the post 10 and the at least one cover 20 should be appropriately configured to have cross-sectional shapes that will allow the desired number of longitudinal channels 30 to be defined by the post 10 and the at least one cover 20. For example, as shown in FIG. 4(*a*), to form a pole 100 having only one longitudinal channel 30, a minimum of one cover 20 is required, and one or both of the post 10 and the cover 20 should have a cross-sectional shape that is at least partially curved and/or angled about a longitudinal axis in order for the longitudinal channel 30 to have sufficient cross-sectional area to enclose devices within the pole 100. To form a pole 100 having three or more longitudinal channels, as shown in FIG. 4(*b*), the pole 100 may comprise a number of covers 20 and the post 10 may comprise a number of longitudinal ribs 11 that are equal to the number of covers 20 as well as equal to the number of desired longitudinal channels 30. In this way, a plurality of longitudinal channels 30 are formed wherein each longitudinal channel 30 is defined by one of the number of covers 20 and two adjacent ribs 11 of the post 10. Each cover 20 is in pivotable engagement with one rib 11 of the post 10. For example, the pole 100 depicted in FIG. 4(*b*) comprises a post 10 having four longitudinal ribs 11 that together with four covers 20 define four longitudinal channels 30. Appreciably, a plurality of vertically arranged covers 20 may be provided between two adjacent ribs 11 of the post 20 in order to define a longitudinal channel 30 (not shown).

As can be seen in FIGS. 1, 2, and 5 to 9, in exemplary embodiments, the pivotable engagement 40 between each cover 20 and the post 10 may be achieved via at least one hinge 40. The hinge 40 comprises a first hinge portion 41 that is provided on the post 10 and a second hinge portion 42 that is provided on an edge of the cover 20, preferably a vertical edge of the cover 20. In preferred embodiments, the first hinge portion 41 is integral with the post 10 and the second hinge portion 42 is integral with the cover 20, as can be seen in FIGS. 1, 2, 5 and 6, such that the cover 20 directly and pivotably engages the post 10 without anything in between. In an exemplary embodiment, the post 10 comprising the first hinge portion 41 and the at least one cover 20 comprising the second hinge portion 42 may each be integrally formed by extrusion.

Figure 6:
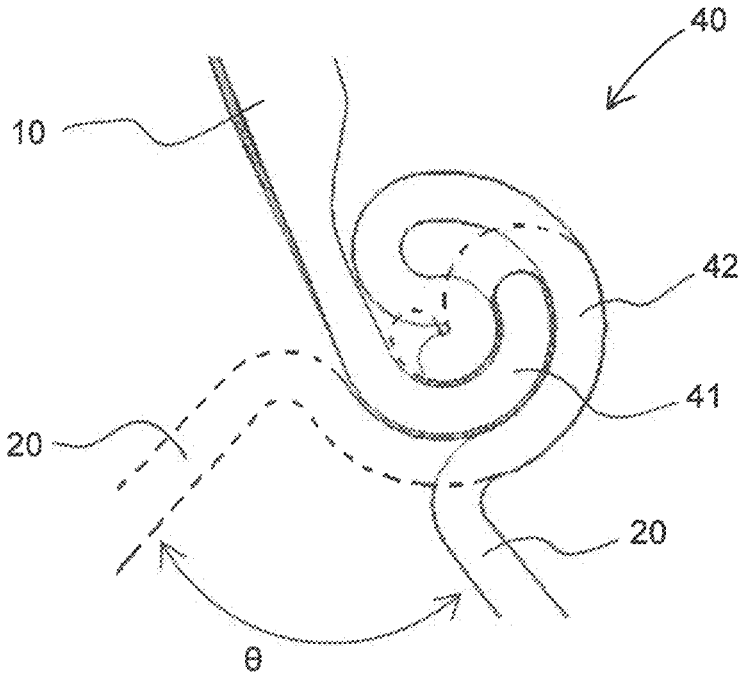
FIG. 6 is a close-up cross-sectional view of the hinge of FIG. 5 with the cover in an open position (dotted lines) and a closed position (solid lines).

As shown in FIG. 6, in an exemplary embodiment, the hinge 40 may comprise a pinless hinge 40 wherein the first hinge portion 41 and the second hinge portion 42 each comprise detachably mating structures that rotatably engage each other over a predetermined angle of rotation θ between a closed position of the cover 20 (shown in solid lines) and a widest possible open position of the cover 20 (shown in dotted lines) relative to the post 10. Such a hinge 40 needs no other parts such as pins or pivots in order to function.

Figure 7:
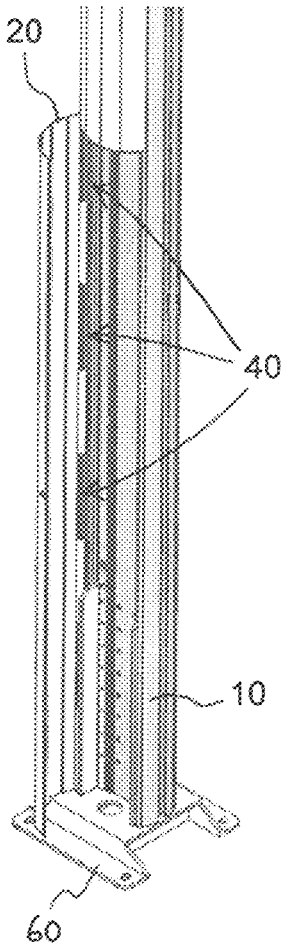
FIG. 7 is a perspective view of an open cover in the pole.
Figure 8:
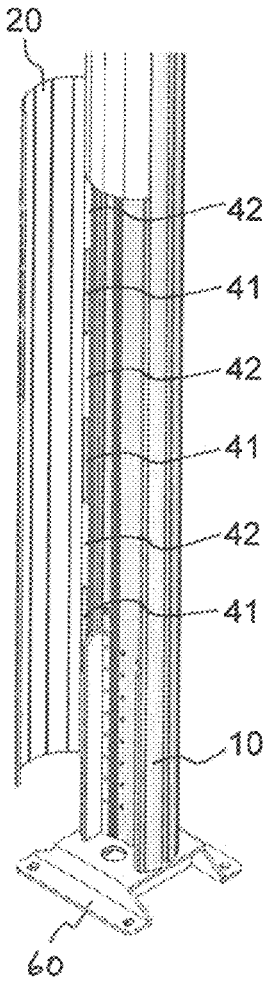
FIG. 8 is a perspective of the cover of FIG. 7 being disengaged from the post.
Figure 9:
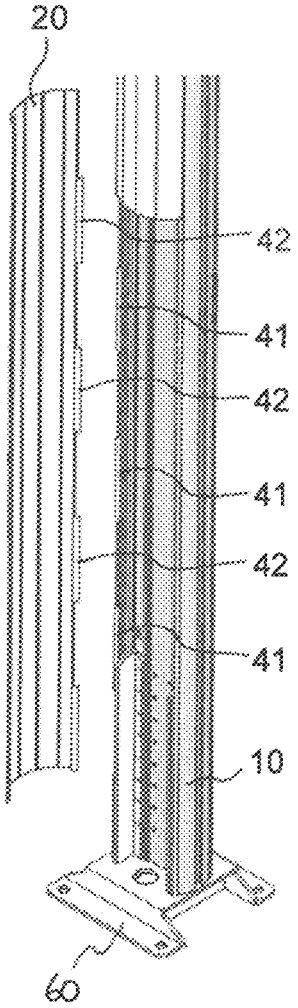
FIG. 9 is a perspective view of the cover of FIG. 8 detached from the post.

As can be seen in FIG. 7, in an exemplary embodiment, a cover 20 may pivotably engage the post 10 via a plurality of integrally formed pinless hinges 40 as described above. When the pinless hinges 40 are spaced apart from each other by intervals greater than a length of one hinge 40 as shown in FIG. 8, to detach the cover 20 from the post 10, the cover 20 may simply be slid upwards (or downwards depending on the location of the cover 20 along the length of the pole 100) to disengage the first hinge portions 41 on the post 10 from the second hinge portions 42 on the cover 20. This allows the cover 20 to then be laterally detached from the post 10, as shown in FIG. 9. This configuration of the hinges 40 allows the cover 20 to be easily removed from the pole 100 in a simple manoeuvre by hand, without requiring the use of tools. Reversing the manoeuvre re-attaches the cover 20 to the post 10. Thus, a pole 100 that is provided with one or more covers 20 in pivotable engagement 40 with the post 10 via pinless hinges 40 that are sufficiently spaced apart as described above advantageously allows covers 20 of the pole 100 to be easily removed and replaced without requiring the post 10 to be taken down. This allows the pole 100 to be readily customized by changing the covers 20 to suit various functions. For example, an originally opaque cover 20 may be readily replaced with a transparent cover 20 when it is desired to attach a camera to the pole 100 so that the camera in the pole 100 can take photographs through the transparent cover 20. Such a configuration of the hinges 40 also allows the pole 100 to be easily assembled using fewer tools as the at least one cover 20 of the pole 100 can be readily slotted into pivotable engagement 40 with the post 10 by hand without using any tools.

To secure the pole 100 to the ground or floor, as shown in FIGS. 3 and 7 to 9, in an exemplary embodiment, a base 60 may be provided to which a bottom end of the post 20 may be secured by known means such as screws or bolts and nuts.

To assemble the pole 100, the base 60 may first be installed on the ground or floor, followed by securing the post 10 to the base 60, followed by attaching covers 20 to the post 10.

The above described pole 100 thus provides an aesthetically pleasing streamlined structure that allows IoT and other devices 50 to be easily attached to and concealed within the pole 100 at any desired height. One or more covers 20 preferably directly and pivotably engage the post 10, thereby minimizing the number of parts required to assemble the pole 100. The pole 100 is thus easily assembled and also easily customized as the covers 20 can be removed and replaced by hand without requiring the use of tools and without requiring the post 10 to be taken down.

Whilst there has been described in the foregoing description exemplary embodiments of the present invention, it will be understood by those skilled in the technology concerned that many variations and combination in details of design, construction and/or operation may be made without departing from the present invention. For example, features that may be described for some embodiments may be incorporated into other embodiments and the different features described for the different embodiments may be combined in different ways to form yet other embodiments of the pole.

The invention claimed is:

1. A pole for supporting at least one device thereon, the pole comprising:

a post to support weight of the pole and to attach the at least one device thereto; and at least one cover at least partially covering at least one side of the post, the post and the at least one cover together defining at least part of a longitudinal channel in the pole to house the at least one device attached to the post;

wherein an edge of the cover is in pivotable engagement with the post to allow access to the post in the longitudinal channel, wherein the pivotable engagement comprises at least one hinge having a first hinge portion integral with the post and a second hinge portion integral with the cover, the first and second hinge portions defining a pinless hinge such that the cover directly and pivotably engages the post without anything in between, and wherein the post comprises a number of ribs and the at least one cover comprises a number of covers corresponding to the number of ribs, the pole comprising a number of longitudinal channels corresponding to the number of covers, wherein each of the number of longitudinal channels is defined by one cover and two adjacent ribs.

2. The pole of claim 1, wherein the first hinge portion and the second hinge portion each comprise detachably mating structures that rotatably engage each other over a predetermined angle of rotation between a closed position of the cover and a widest possible open position of the cover relative to the post.

3. The pole of claim 2, wherein the pivotable engagement comprises a plurality of hinges spaced apart from each other by intervals greater than a length of one hinge.

4. The pole of claim 1, wherein the at least one cover comprises a number of vertically arranged covers.

5. The pole of claim 1, wherein the at least one cover is at least partially curved and/or angled about a longitudinal axis.

6. The pole of claim 1, wherein the post is at least partially curved and/or angled about a longitudinal axis.

7. The pole of claim 1, wherein the at least one cover is readily assembled with and detached from the post by hand without requiring use of tools.

8. The pole of claim 1, wherein total height of the at least one cover spans at least most of a full length of the post.

9. A pole for supporting at least one device thereon, the pole comprising:

a post to support weight of the pole and to attach the at least one device thereto; and at least one cover at least partially covering at least one side of the post, the post and the at least one cover together defining at least part of a longitudinal channel in the pole to house the at least one device attached to the post;

wherein an edge of the cover is in pivotable engagement with the post to allow access to the post in the longitudinal channel, wherein the pivotable engagement comprises at least one hinge having a first hinge portion integral with the post and a second hinge portion integral with the cover, the first and second hinge portions defining a pinless hinge such that the cover directly and pivotably engages the post without anything in between, wherein the first hinge portion and the second hinge portion each comprise detachably mating structures that rotatably engage each other over a predetermined angle of rotation between a closed position of the cover and a widest possible open position of the cover relative to the post, and wherein the pivotable engagement comprises a plurality of hinges spaced apart from each other by intervals greater than a length of one hinge.

10. The pole of claim 9, wherein the at least one cover comprises a number of vertically arranged covers.

11. The pole of claim 9, wherein the at least one cover is at least partially curved and/or angled about a longitudinal axis.

12. The pole of claim 9, wherein the post is at least partially curved and/or angled about a longitudinal axis.

13. The pole of claim 9, wherein the at least one cover is readily assembled with and detached from the post by hand without requiring use of tools.

14. The pole of claim 9, wherein total height of the at least one cover spans at least most of a full length of the post.

* * * * *